United States Patent [19]

Sevak

[11] 4,046,371

[45] Sept. 6, 1977

[54] DOCUMENT STACKING DEVICE

[75] Inventor: Nitin M. Sevak, Westland, Mich.

[73] Assignee: Burroughs Corporation, Detroit, Mich.

[21] Appl. No.: 630,914

[22] Filed: Nov. 11, 1975

[51] Int. Cl.[2] ..... B65H 29/40

[52] U.S. Cl. ..... 271/178; 214/7; 271/214

[58] Field of Search ..... 271/178, 181, 177, 179, 271/180, 80, 214; 214/7

[56] References Cited

U.S. PATENT DOCUMENTS

| | | | |
|---|---|---|---|
| 541,163 | 6/1895 | Hey | 271/178 X |
| 896,366 | 8/1908 | Evans | 271/178 X |
| 3,166,313 | 1/1965 | Rehm | 271/178 |
| 3,568,860 | 3/1971 | Rawlins | 271/178 X |
| 3,667,623 | 6/1972 | Frazier et al. | 271/181 X |

OTHER PUBLICATIONS

Jones, W. B., "Document Stacker", IBM Technical Disclosure Bulletin, vol. 6, No. 9, Feb. 1964, pp, 55, 56.

*Primary Examiner*—Bruce H. Stoner, Jr.
*Attorney, Agent, or Firm*—Larry Michael Jarvis; Kevin R. Peterson

[57] ABSTRACT

A high speed sheet stacking device for stacking documents on edge as they are serially ejected from a sheet transport apparatus into preselected sorting pockets. A pair of spaced-apart paddle wheels coaxially disposed subjacent to the pocket are rotatively driven through apertures formed therein, displacing the documents to the back side of the pocket in a serially stacked arrangement. The paddles remain outside of the pocket until advanced in rotative steps of 90° responsive to the passing of a document past a predetermined point enroute to the stacking pocket. A thin wire spring secured to the outer end of each paddle aids in displacing the documents during stacking and remains bent through the pocket floor in holding contact against the stacked sheets after the rotative stepping is completed.

2 Claims, 3 Drawing Figures

DOCUMENT STACKING DEVICE

BACKGROUND OF THE INVENTION

1. Field of the Invention

The invention relates generally to material or article handling and stacking apparatus, and more particularly to devices or apparatus for stacking sheet like items such as bank checks or similar documents in sequence of entry within document sorting pockets.

2. Description of the Prior Art

It is well-known in the document handling art to sort documents such as bank checks or data processing cards moving at high rates of speed by separating the same into a number of sorting pockets corresponding to various coding criteria. Document stacking apparatus located within each sorting pocket are coordinated with the flow of documents to stack the sheets on edge in sequence of entry within the preselected pockets.

Various means have been developed for stacking the sorted documents within pockets including cantilever springs, air jets, and the like, which kick the trailing end of each document as it passes into the pocket, imparting a sideward motion thereto for carrying the document onto a stationary stack. Examples of such stackers are illustrated by U.S. Pat. Nos. 3,628,788, 3,131,932 and 2,944,813 issued to W. L. Simmons, E. P. Maidment and J. G. Smith, respectively, and assigned to the same assignee as the present invention. While such stackers aid in preventing rear end collisons of the documents as they enter the pocket, their performance becomes limited by the passing clearance between the front edge of the incoming document and the tail end of the preceding document, and limited by the speed at which the documents are transported.

For example, the use of air jets requires spacing between documents to prevent the air jets from simultaneously pushing the tail end of one document and the front end of an incoming document, and also to permit sufficient flow of air to move the document into position. Whereas with the use of a kicker spring enough time should be allowed between consecutively entering documents for stacking the documents, due to the natural frequency-dependency characteristic of the spring.

Thus, the invention of a high speed stacking apparatus which is not limited by its slow response or natural frequency to stack documents is highly welcomed in the document handling art.

SUMMARY OF THE INVENTION

It is, therefore, an object of the invention to provide an improved, high speed sheet stacking apparatus which will stack sheets on edge in sequence of entry within document sorting pockets or the like.

It is another object of this invention to provide a high speed sheet stacker for serially stacking sheets within document sorting pockets, which stacker is not limited by the interspacing of documents entering the pocket.

It is yet another object of this invention to provide a high speed stacker capable of stacking overlapped documents in sequence of entry within document sorting pockets.

It is still further an object of this invention to provide a high speed sheet stacker fulfilling the immediate foregoing objects while maintaining the last stacked document onto the document pile when awaiting subsequent document stacking.

Accordingly, this invention provides a high speed sheet stacker for stacking documents on edge as they are serially ejected from a sheet transport apparatus into preselected sorting pockets. Each document receiving pocket has a side wall defining a portion of the transport path for guiding the ejected document on edge into the pocket. A pair of spaced-apart paddle wheels coaxially disposed subjacent to the pocket rotate through apertures formed in the side wall and pocket floor in response to a document entering the pocket. The paddle wheels are rotated in 90° steps, advancing one paddle from each wheel into and out of the pocket, carrying the document away from the guide wall and serially stacking the same against a movably biased backup member. During rotation, the paddles deflect the document away from the guide wall out of its straight line path of movement to clear the way of the next incoming document even before the document is stacked. A thin wire spring is secured to the outer end of each paddle of the forward paddle wheel to aid in displacing the documents during stacking, and remains bent through the pocket floor in holding contact against the stacked document after the paddle movement is completed.

Other objects, features and advantages will be readily apparent from the following detailed description when considered with the accompanying drawings which show by way of example and not limitation the principle of the invention and preferred modes of applying that principle.

DESCRIPTION OF THE PREFERRED EMBODIMENT

Figure 1:
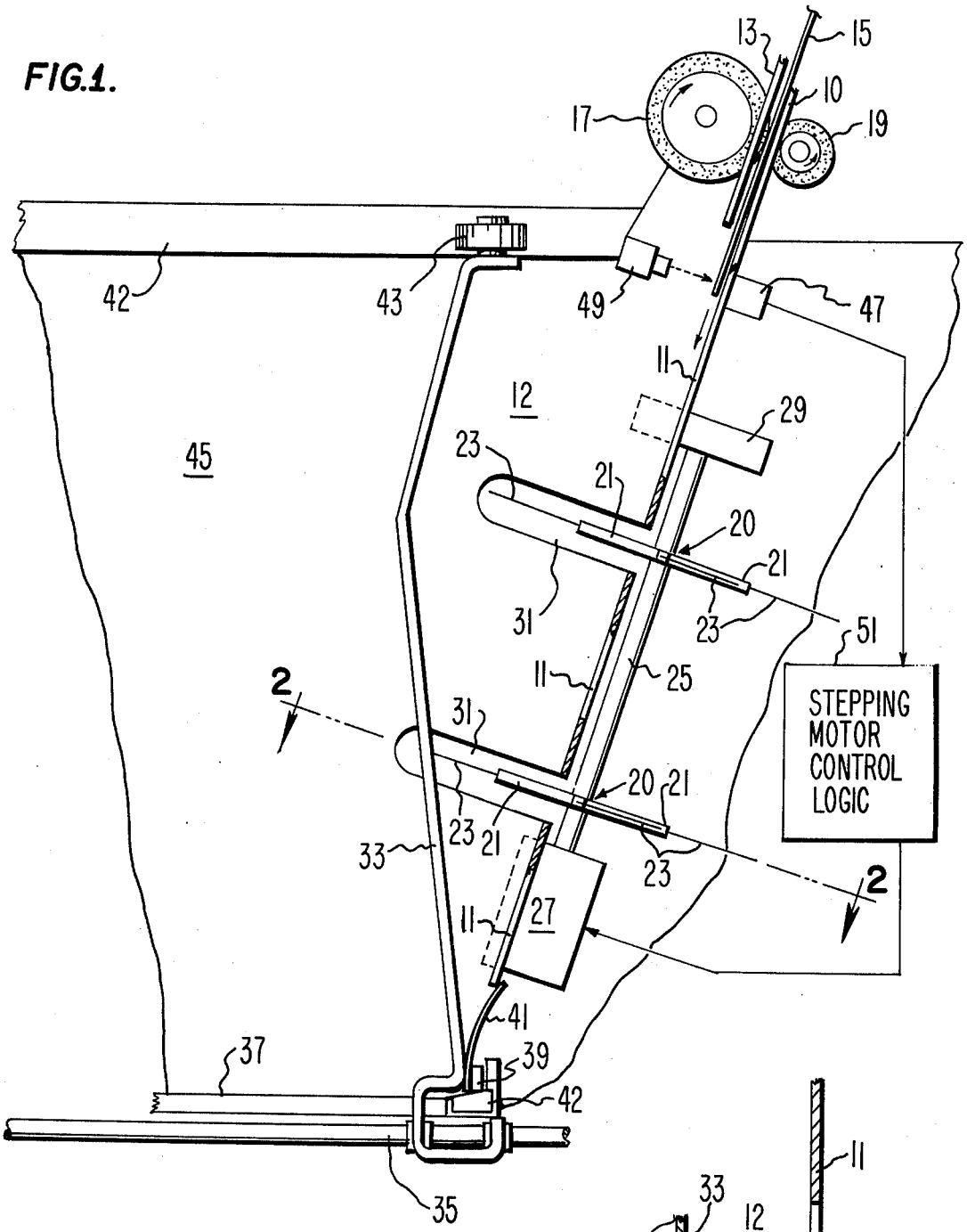
FIG. 1 is a top plan view of the sheet stacking apparatus of the present invention.
Figure 3:
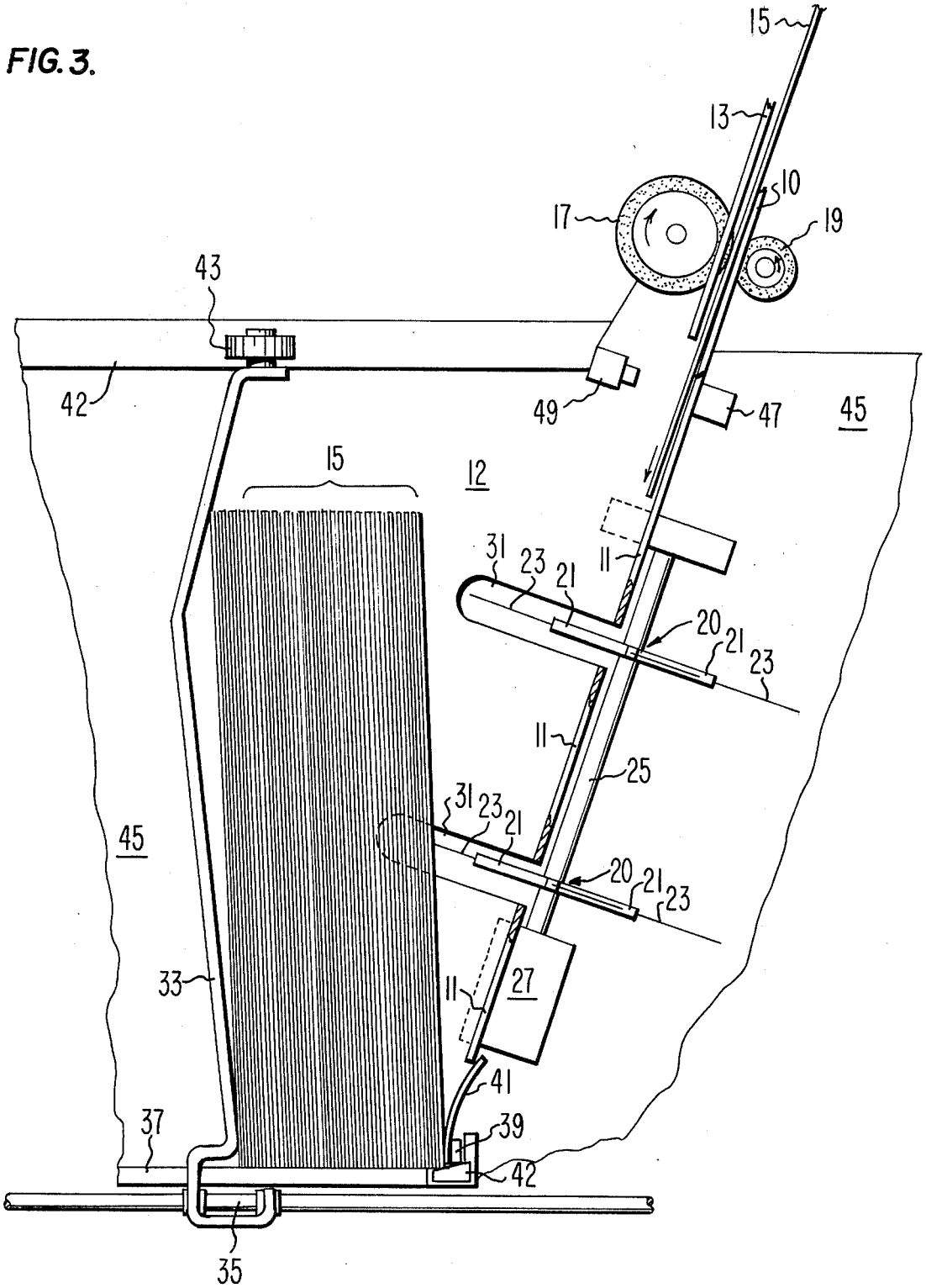
FIG. 3 is a top plan view of the apparatus partially filled with documents.

As illustrated in FIGS. 1 and 3, the document stacker of the present invention operates to stack documents 15, such as bank checks and the like, in an orderly pile within a document sorting pocket 12 as the documents enter the pocket on edge from a sheet transport apparatus (not shown). The documents enter the pocket along a stationary guide wall comprising two coplanar wall members 10, 11 which serve to define a side wall of the sorting pocket, and are stacked lengthwise against a movable backup member 33 laterally disposed opposite the guide wall and biasedly urged theretowards. The backup member 33 is slidably supported at one end thereof on a linear bearing 35 and at the other end by a roller 43 which travels along a ledge member 42. The remaining boundaries of the pocket are defined by a floor member 45 and a front wall member 37 set orthogonal to each other.

At the entrance to the pocket, a guide member 13 cooperates with the guide wall 10 for guiding the document on edge into the bight of a drive roller 17 and an idler roller 19, which eject the documents from the transport apparatus into the sorting pocket 12. The peripheral portions of the rollers 17, 19 pass through apertures formed in the respective members 10, 13 for making rolling contact.

Upon ejectment from the transport apparatus, the document travels the length of guide wall 11 striking a snubber plate 41 which is flexibly suspended to extend the guide wall 11 to a rubber bumper 42 secured to the front wall member 37, as illustrated in FIG. 1. The impact of the document against the snubber plate 41 causes the compression of a flexural spring 39 held contiguous to the backside of the snubber plate, which yields to make room for the incoming document as it bottoms against the rubber bumper 42 in substantial edgewise alignment with the front wall member 37. The leading edge of the document is thus aligned along the front wall member with other similarly stacked items and is held against the document pile by the action of the snubber plate 41 and biased backup member 33 gripping the pile.

In this manner, the area of the pocket 12 terminates in a single point defined by the intersection of the last stacked document and guide wall 11, for directing the document to only one position along the front wall member 37. However, if the bin is empty the backup member 33 serves to direct the document to this position. Thus, as the document enters the pocket, it travels to this point, and aligns itself with other documents.

The document in its forward travel toward the front wall member 37 is deflected away from the guide wall and out of its straight line path of movement to clear the way of the next incoming document. The deflection is accomplished by a pair of paddle wheels 20 incrementally rotated through clearance apertures 31 formed in the guide wall 11 and pocket floor 45. The paddles rotate in steps of 90° passing into and out of the pocket for kicking the trailing end of each document over toward the backup plate 33.

Figure 2:
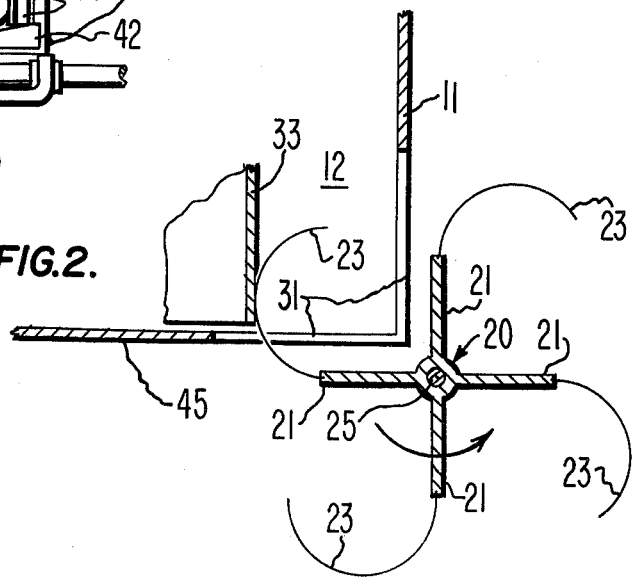
FIG. 2 is a cross section view of a portion of the document stacking apparatus taken along lines 2—2 of FIG. 1.

Each paddle wheel includes four orthogonally distributed paddle arms 21 lying in a single plane for rotation about an axis parallel to the direction of travel of documents entering the pocket. The axis of rotation lies outside of the pocket, positioned approximately 45 degrees subjacent to the corner thereof defined by the meeting of guide wall 11 and pocket floor 45 (FIG. 2). The paddle wheels are spaced apart, being set a prescribed distance along the axis of rotation for striking a predetermined portion of the face of each document, as desired.

Secured to the outer end of each paddle of at least the paddle wheel closest to front wall member 37, is a thin wire spring 23 somewhat curvilinear in configuration, as illustrated in FIG. 2. The spring acts as an arcuate extension of each paddle arm for aiding in the lateral displacement of the document. After the paddle has passed through the pocket floor and come to rest therebelow, the spring remains bent through the floor aperture in holding contact against the last stacked document. The configuration of the spring is thus designed in conformity with the locus of the outer end of the paddle and the position of the last stacked document for providing a spring-like bias sufficient to maintain the last stacked document against the stack. Because the spring bends upwardly from the outer end of the paddle, the pocket remains unobstructed to receive the next incoming document.

The paddle wheels are advanced in arcuate steps of 90° by a stepping motor 27 via shaft 25. The shaft terminates in a bearing block 29 and is angularly set therein to maintain the paddles outside of the pocket until the stepping motor is enabled.

The control of the stepping motor is effectuated by control logic 51 actuated by a photocell sensing device 47 functioning in combination with a light source 49 to detect the leading edge of the document being stacked. The control logic includes electrical circuitry and timing elements for energizing the stepping motor after a predetermined time delay, allowing the document to travel fully within the bin in position to impact the snubber plate 41. Because the snubber plate 41 functions as a frictional brake to reduce the speed of the document, the paddles must begin to deflect the traveling document just prior to document deceleration in the event a subsequent entering document is closely-spaced therebehind. Thus, the simplest control logic may be a time delay element electrically coupled to stepping motor drive circuitry for rotating the paddles just prior to the document's impact against snubber plate 41.

The rate of rotation of the stepping motor may be set, given a known rate of document travel and taking into account minimum spacing between documents. This is apparent, recognizing that as the paddle arm lifts the document from the guide wall, a discrete amount of time (dependent upon the rate of document travel) is available as the subsequently entering document must pass along the guide wall into the same position the previous document was kicked from, i.e. the loading position. During this time the document must be stacked and the paddles passed through the pocket floor to make ready for the incoming document advancing to the loading position.

Where documents inadvertently obtain an overlapped condition or are purposely desired to be stacked from a shingled relationship, the present invention provides such stacking capabilities as long as the previous entering document is to the stack-side of the overlap as the document travels into the pocket. Consequently, the motor must be driven at a different rate in accordance with the reasoning previously discussed and the sensing means must be adapted to sense that an overlapped condition has occurred and to determine the length of the overlap. The control logic interprets this information from the sensing means for establishing a proper rate and time for stepping.

Because the paddle arm is relatively thin, its effect upon the timing of the device is relatively negligible. The length of the arm, the location of the arm along the axis of rotation, and the relative positioning of the axis of the shaft 25 with respect to the corner of the pocket may each be varied with a corresponding effect on the required speed of the stepping motor.

Of course, many other modifications of the disclosed device may be suggested including the control of the motor speed responsive to the particular spacing between documents. The paddle wheels may be set at different angles with respect to the path of document travel and they may be rotated by separate shafts and motors in cooperation with the purpose of the control logic.

It should be understood, of course, that the foregoing disclosure relates to a preferred embodiment of the invention and that many other modifications or alterations may be made therein without departing from the spirit or scope of the invention as set forth in the appended claims.

What is claimed is:

1. In a sheet handling apparatus having means to transport a sheet on edge along a path of travel, a sheet stacking device comprising:

a document receiving pocket having a first side wall defining a portion of a transport path for guiding a transported sheet on edge into said pocket; a second side wall movably disposed opposite said first side wall and biasedly urged theretowards, and against which the successive sheets are to be stacked; an end wall to limit the travel of the sheet to align the leading edge of the sheets thereagainst; a pocket floor upon which the sheets are edgewise supported within said pocket;

means defining an aperture formed in said pocket for providing an opening through said first side wall and said pocket floor;

paddle wheel means having at least one paddle arm incrementally rotatable through said opening of said pocket, said paddle wheel means having an axis of rotation disposed subjacent to said pocket and in relatively close proximity to said first side wall;

control means responsive to a sheet passing a predetermined point en route to said pocket for enabling incremental rotation of a said paddle arm through said pocket in timed relation with said moving sheet to impart a sideward motion thereto to carry the same over toward said second side wall; and spring means secured to the outer end of said paddle arm and cooperable therewith to deflect the sheet toward said second sidewall, said spring means for biasingly urging the last stacked sheet in holding contact against the previously stacked sheets after the stacking of said last stacked sheet is completed.

2. A device for deflecting the trailing end of a document onto a stack as documents are serially transported on edge into the proximity of the stack, comprising:

a guiding plate having a front surface defining a portion of a transport path for directing the leading edge of a document into alignment with and onto a stack, said guiding plate having an opening formed therein communicating the back side of said guide plate with said front guide surface thereof;

deflecting means defining a paddle wheel having at least one paddle arm, rotatably disposed about an axis of rotation lying to said back side of said guide plate and subjacent thereto for carrying said paddle arm uniformly in one direction through said opening toward the stack;

control means responsive to a document passing a predetermined point en route to the stack for incrementally rotating said deflecting means in timed relation with the moving document for deflecting the trailing end of the document onto the stack, whereby the document is carried off the guide plate to clear the path of a subsequently transported document; and spring means secured to the outer end of said paddles arm and cooperable therewith to deflect the documents onto the stack and for applying pressure to the last stacked document holding the same against the stack after the stacking of said last stacked document is completed, said spring means being so constructed for keeping the path of document travel along the guide plate unobstructed between stacking.

* * * * *